US010427400B2

(12) United States Patent
Yamato et al.

(10) Patent No.: US 10,427,400 B2
(45) Date of Patent: Oct. 1, 2019

(54) PRINTHEAD AND PRINTING APPARATUS

(71) Applicant: CANON KABUSHIKI KAISHA, Tokyo (JP)

(72) Inventors: Hidenori Yamato, Tokyo (JP); Hideo Kanno, Yokohama (JP); Masataka Sakurai, Kawasaki (JP); Ryo Kasai, Tokyo (JP); Kengo Umeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/837,470

(22) Filed: Dec. 11, 2017

(65) Prior Publication Data

US 2018/0194133 A1 Jul. 12, 2018

(30) Foreign Application Priority Data

Jan. 6, 2017 (JP) ..... 2017-001432

(51) Int. Cl.
*B41J 2/045* (2006.01)

(52) U.S. Cl.
CPC ..... *B41J 2/04548* (2013.01); *B41J 2/0458* (2013.01); *B41J 2/04518* (2013.01); *B41J 2/04541* (2013.01); *B41J 2/04563* (2013.01); *B41J 2/04565* (2013.01)

(58) Field of Classification Search
CPC ..... B41J 2/04518; B41J 2/04541; B41J 2/04563; B41J 2/04565; B41J 2/0458; B41J 2/04548
See application file for complete search history.

(56) References Cited

U.S. PATENT DOCUMENTS

| | | | | |
|---|---|---|---|---|
| 6,474,782 | B1 | 11/2002 | Furukawa | |
| 7,581,797 | B2 | 9/2009 | Kasai | |
| 7,722,148 | B2 | 5/2010 | Takabayashi et al. | |
| 7,815,272 | B2 | 10/2010 | Kasai et al. | |
| 7,918,538 | B2 | 4/2011 | Sakurai | |
| 8,147,039 | B2 | 4/2012 | Kurokawa et al. | |
| 8,287,082 | B2 | 10/2012 | Aoki et al. | |
| 9,283,748 | B2 | 3/2016 | Umeda et al. | |
| 9,555,653 | B2 | 1/2017 | Kanno | |
| 2007/0280720 | A1* | 12/2007 | Kimura | G03G 15/80 399/88 |
| 2009/0085946 | A1 | 4/2009 | Aoki et al. | |

FOREIGN PATENT DOCUMENTS

JP 3658297 B2 6/2005

* cited by examiner

*Primary Examiner* — Lamson D Nguyen
(74) *Attorney, Agent, or Firm* — Venable LLP

(57) ABSTRACT

A printhead comprises a printing element, a driving circuit configured to drive the printing element, an analog signal processing circuit configured to process one or more analog signals, a bias circuit configured to supply a bias voltage to the analog signal processing circuit, and a control terminal to which a control signal is inputted. In a state in which the analog signal processing circuit and the bias circuit are receiving a supply of power, it is possible to switch starting and stopping of at least one of the analog signal processing circuit and the bias circuit based on the control signal.

14 Claims, 18 Drawing Sheets

PRINTHEAD AND PRINTING APPARATUS

BACKGROUND OF THE INVENTION

Field of the Invention

The present invention relates to a printhead and a printing apparatus.

Description of the Related Art

A frequency of a clock supplied to a print element substrate has been increasing in conjunction with higher printing speeds in recent years, and in addition there is demand to be able to more accurately monitor an analog signal for a substrate temperature, element resistance value, or the like. To avoid electromagnetic noise arising from a high frequency digital circuit inducing a malfunction of an analog circuit that performs temperature detection at high precision, a configuration is taken in which a digital circuit power supply voltage and an analog circuit power supply voltage of a print element substrate are separately supplied to suppress noise. Here, a digital circuit is a circuit that operates by using a discrete voltage value, such as a latch circuit or a shift register circuit. In addition, an analog circuit is a circuit that operates by using a continuous voltage value or current value. A bias circuit or an operational amplifier or the like may be given as examples of an analog circuit.

Japanese Patent No. 3658297 describes a configuration in which, on a print element substrate, a power supply voltage (Vdd) is supplied to a digital circuit, an analog power supply voltage (VddA) is supplied to an analog circuit, and the power supply voltage (Vdd) and the analog power supply voltage (VddA) are both connected on the printhead substrate by flexible cables or the like. By this, it is possible to reduce mutual noise propagation of power supply voltages in the print element substrate.

The analog circuit of the print element substrate uses a circuit such as a bias circuit or an operational amplifier circuit through which consumed current constantly flows when a power supply is applied, and current consumption increases in conjunction with an increase in the number of functions of the print element substrate. In particular, in the case of a printhead provided with a plurality of print element substrates such as a full-line printhead, current consumption greatly increases even for a circuit that operates at a low voltage (for example, 3.3 volts or 5 volts). When the power supply for the printhead is turned off when not printing in order to reduce average current consumption, time is incurred for activation of the analog circuit when the power supply is turned on to start printing.

SUMMARY OF THE INVENTION

The present invention is made to solve the foregoing problem, and causes power consumption to reduce by stopping a function of an analog circuit even in a state where power is supplied to the analog circuit.

According to one aspect of the present invention, there is provided a printhead comprising: a printing element; a driving circuit configured to drive the printing element; an analog signal processing circuit configured to process one or more analog signals; a bias circuit configured to supply a bias voltage to the analog signal processing circuit; and a control terminal to which a control signal is inputted, wherein, in a state where the analog signal processing circuit and the bias circuit are receiving a supply of power, it is possible to switch starting and stopping of at least one of the analog signal processing circuit and the bias circuit based on the control signal.

According to another aspect of the present invention, there is provided a printing apparatus comprising: a printhead; and a control unit configured to control the printhead, wherein the printhead comprises: a printing element; a driving circuit configured to drive the printing element; an analog signal processing circuit configured to process an analog signal; and a bias circuit configured to supply a bias voltage to the analog signal processing circuit, wherein it is possible to switch starting and stopping of at least one of the analog signal processing circuit and the bias circuit based on a control signal, and the control unit outputs the control signal to the printhead.

By virtue of the present invention, it is possible to provide a printhead that can suppress power consumption of an analog circuit even in a state where power is supplied to the analog circuit.

Further features of the present invention will become apparent from the following description of exemplary embodiments (with reference to the attached drawings).

DESCRIPTION OF THE EMBODIMENTS

Figure 1:
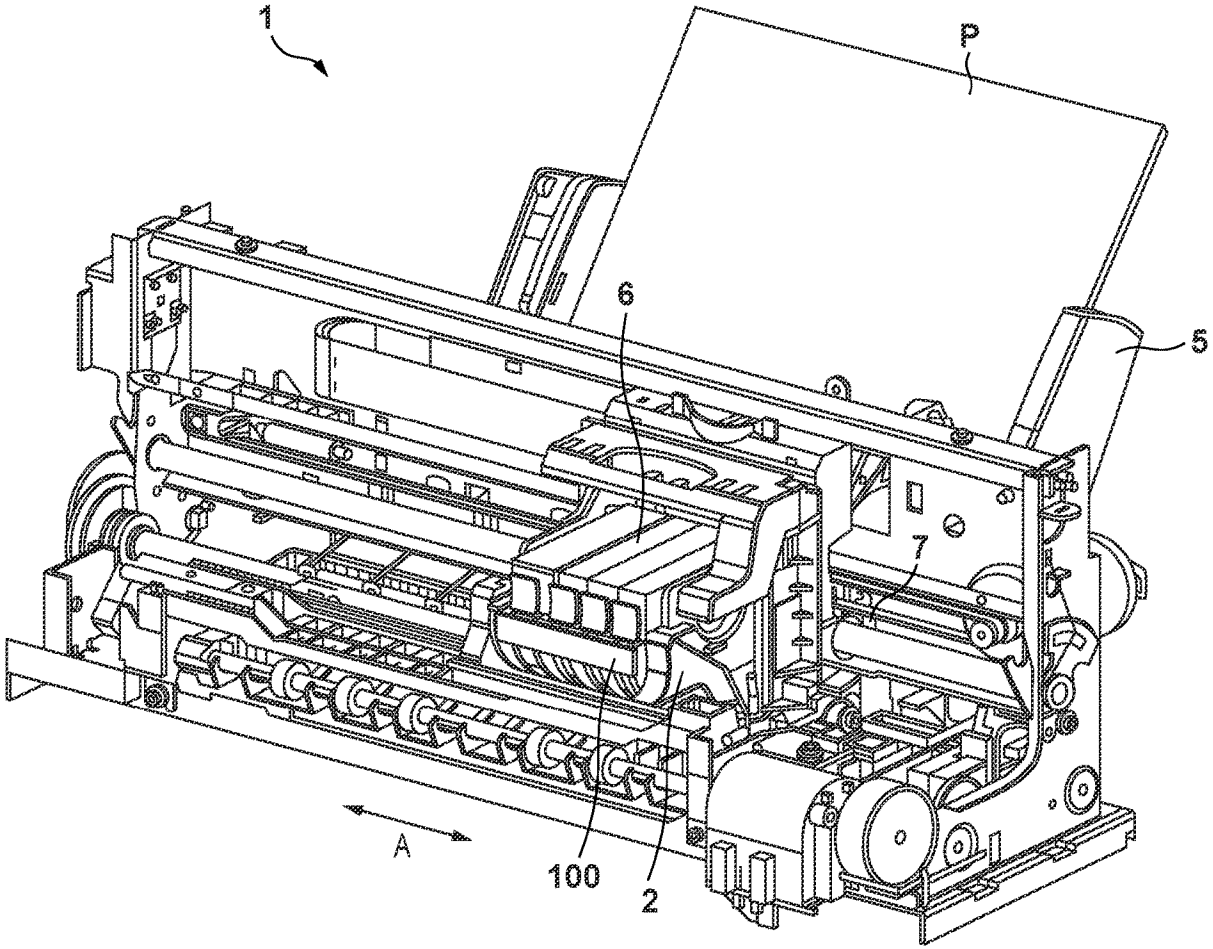
FIG. 1 is a perspective view illustrating an example of a configuration of an outer appearance of a printing apparatus according to the invention of the present application.

Explanation is given below regarding embodiments of the present invention with reference to the attached drawings.

Note that the following embodiments do not limit the present invention in regard to the scope of the patent claims, and, in addition, not all combinations of the features explained in the embodiments are necessarily required in the means for solving the present invention. Note that the same reference numerals have been added to the same configuration elements, and explanation thereof is omitted.

Note that in this specification, "print" encompasses forming not only meaningful information such as characters and shapes, but also meaningless information. Furthermore, "print" broadly encompasses cases in which an image or pattern is formed on a print medium irrespective of whether or not it is something that a person can visually perceive, and cases in which a medium is processed.

Also, "print medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Accordingly, "ink" encompasses liquids that by being applied to a print medium can be supplied in the forming of images, patterns or the like, processing of print mediums, or processing of ink (for example, insolubilization or freezing of a colorant in ink applied to a print medium).

Furthermore, "print element", unless specified otherwise, encompasses a discharge port and an element that produces energy that is used for discharge of ink and a fluid channel that communicates therewith collectively.

Furthermore, "nozzle", unless specified otherwise, encompasses a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring lines, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

For an inkjet printhead (hereinafter referred to as printhead) having the most important features of the present invention, on an element substrate of a printhead, a plurality of printing elements and a driving circuit that drives these printing elements are implemented on the same substrate. As will be clear from the description below, a plurality of element substrates are integrated in a printhead, and these element substrates have a cascade connection structure. Accordingly, this printhead is able to achieve a print width that is relatively long. Accordingly, the printhead is used not only in a serial type printing apparatus that is commonly found, but also in a printing apparatus comprising a full-line printhead whose print width corresponds to the width of the print medium. Also, the printhead is used in large format printers that use print mediums of a large size such as A0 and B0 in serial type printing apparatuses.

[Printing Apparatus Overview Description]

FIG. 1 is an external perspective view illustrating an overview of a configuration of a printing apparatus that performs printing using an inkjet printhead (hereinafter referred to as the printhead) which is a representative embodiment of the present invention.

As illustrated in FIG. 1, in the inkjet printing apparatus (hereinafter referred to as the printing apparatus) 1, an inkjet printhead (hereinafter referred to as the printhead) 100, which performs printing by discharging ink in accordance with an ink-jet method, is mounted on a carriage 2, and printing is performed by causing the carriage 2 to move back and forth in the direction of the arrow symbols A. A print medium P such as a printing paper is fed via a sheet supply mechanism 5, and conveyed to a printing position, and the printing is performed by discharging ink to the print medium P from a printhead 100 at that printing position.

Mounted to the carriage 2 of the printing apparatus 1 is the printhead 100, and also an ink tank 6 containing ink to be supplied to the printhead 100 is attached thereto. The ink tank 6 can be attached/detached in relation to the carriage 2.

The printing apparatus 1 illustrated in FIG. 1 can perform color printing, and four ink cartridges that respectively accommodate magenta (M), cyan (C), yellow (Y), and black (K) ink are mounted to the carriage 2 for this. These four ink cartridges can each be independently attached/detached.

The printhead 100 according to embodiments employs an ink-jet method in which ink is discharged using thermal energy. Accordingly, an electrothermal transducer is comprised. The electrothermal transducer is disposed for each discharge port, and ink is discharged from a corresponding discharge port by applying a pulse voltage to the corresponding electrothermal transducer in accordance with a printing signal. Note that the printing apparatus is not limited to the foregoing serial type printing apparatus, and can be applied to a so-called full-line type printing apparatus in which a printhead (line head) in which discharge ports are arranged in a widthwise direction of the print medium are arranged in a direction of conveyance of the print medium.

Figure 2:
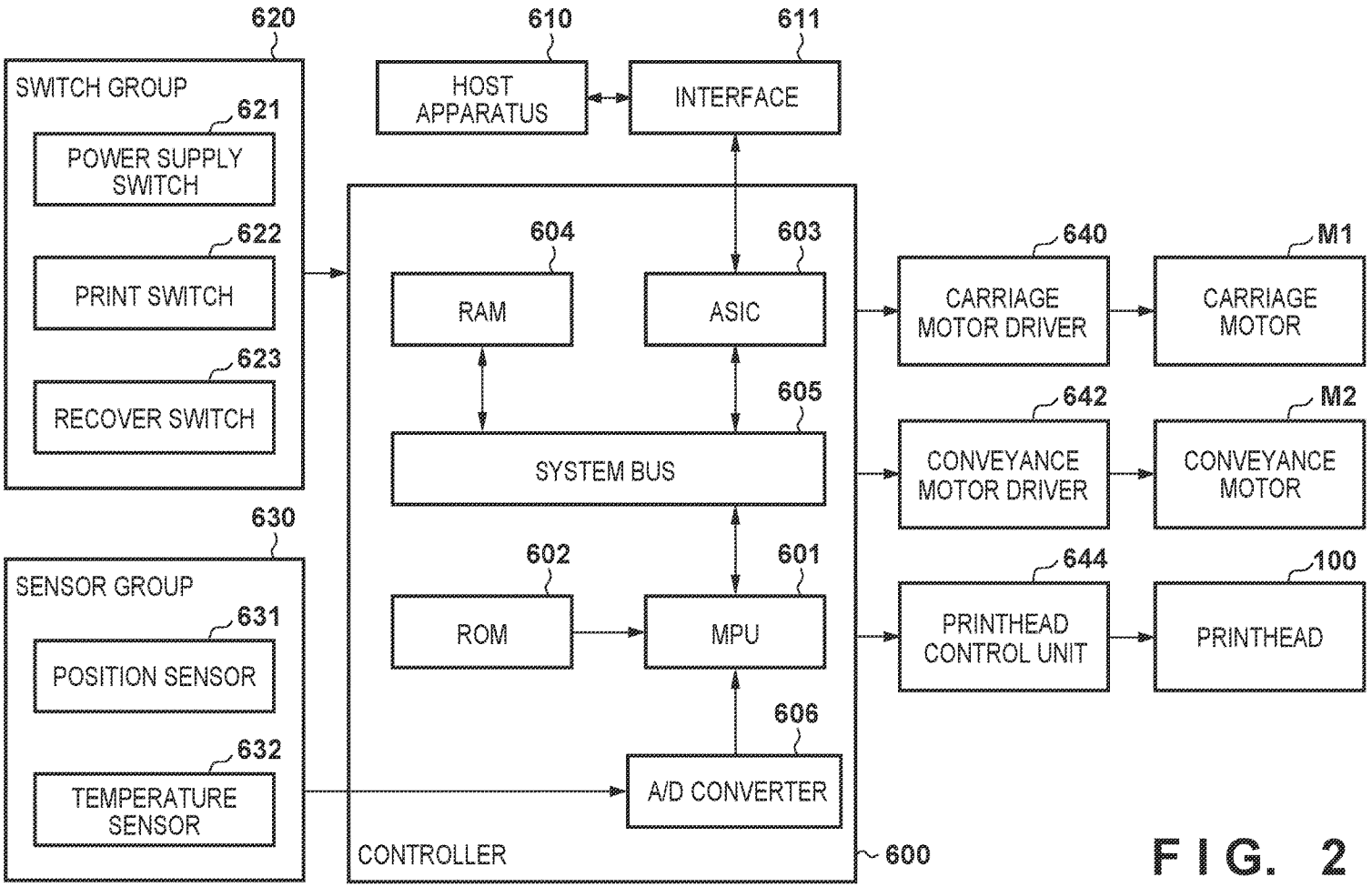
FIG. 2 is a view illustrating an example of a functional configuration of the printing apparatus according to the invention of the present application.

FIG. 2 is a block diagram that illustrates a control configuration of the printing apparatus 1 illustrated in FIG. 1.

As illustrated in FIG. 2, a controller 600 is configured by an MPU 601, a ROM 602, an application-specific integrated circuit (ASIC) 603, a RAM 604, a system bus 605, an A/D converter 606, and the like. The ROM 602 stores programs corresponding to various control sequences, particular tables, and other fixed data. The ASIC 603 generates control signals for control of a carriage motor M1, control of a conveyance motor M2, and control of the printhead 100. The RAM 604 is used as an image data loading region or a work region for execution of programs. The system bus 605 performs reception of data by connecting the MPU 601, the ASIC 603, and the RAM 604 to each other. The A/D converter 606 takes an analog signal as input from a sensor group 630 described below, performs an A/D conversion on it, and supplies the digital signal to the MPU 601.

Also, in FIG. 2, a host apparatus 610 is an external information processing apparatus such as a PC which is a supply source of image data. Image data, commands, statuses, and the like are transmitted/received by packet communication via an interface (I/F) 611 between the host apparatus 610 and the printing apparatus 1. Note, configuration may be taken such that a USB interface is further included separately from the network interface as the interface 611, and such that bit data or raster data transferred serially from the host can be received.

A switch group 620 is configured from a power supply switch 621, a print switch 622, a recover switch 623, and the like. When the power supply switch 621 is turned on, power is supplied from a power supply circuit (not shown) to the printhead 100. When the power supply switch 621 is turned on, other than the printhead 100, power is also supplied to the controller 600 or the like.

The sensor group 630 is sensor group for detecting an apparatus state, and is configured from a position sensor 631, a temperature sensor 632, and the like. A photosensor (not shown) for detecting a remaining amount of ink is also provided.

A carriage motor driver 640 is a carriage motor driver for driving the carriage motor M1 in order to cause the carriage 2 to reciprocally scan in the direction of arrow symbols A. A conveyance motor driver 642 is a conveyance motor driver that drives the conveyance motor M2 which is for conveying the print medium P. A printhead control unit 644 controls operation of the printhead 100.

The ASIC 603 transfers data for driving a heating element (a heater for discharge of ink) to the printhead 100 via the printhead control unit 644 while directly accessing a storage region of the RAM 604 at a time of a print scan by the printhead 100. In addition, the ASIC 603 transfers a control signal to the printhead 100 via the printhead control unit 644 at a stop timing or an operation start timing of an analog circuit. In addition, the printhead control unit 644 is provided with an LVDS (low voltage differential signaling) transmission circuit, and transmits a differential signal to the printhead 100. In addition, a display unit (not shown) configured by an LCD or an LED as a user interface is provided in the printing apparatus 1.

First Embodiment

Figure 3:
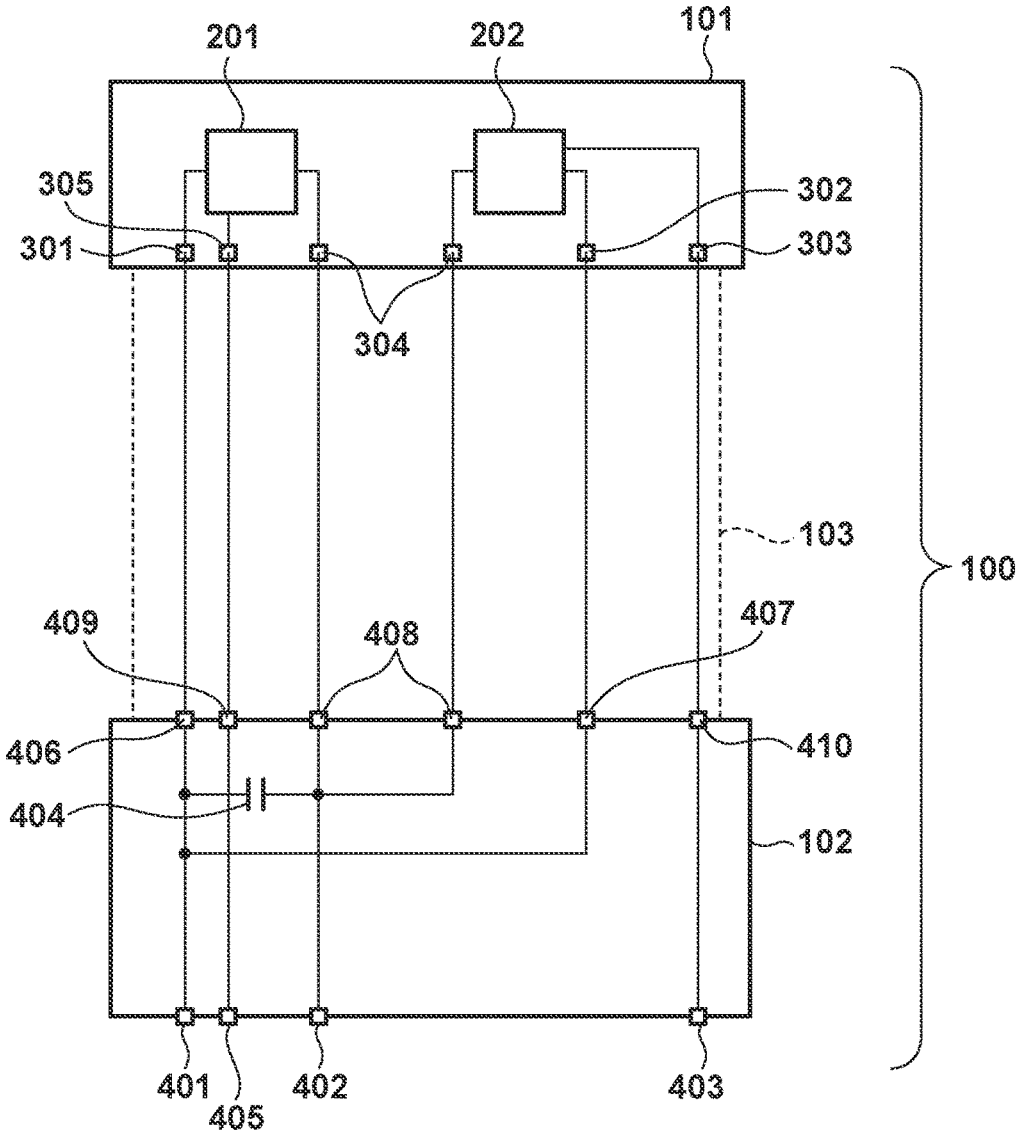
FIG. 3 is a view illustrating an example of a configuration of the printhead according to a first embodiment.

FIG. 3 illustrates an example of a configuration of the printhead 100 according to a first embodiment of the present invention. The printhead 100 is configured from a print element substrate 101, flexible cables 103, and a wiring substrate 102.

The wiring substrate 102 is electrically connected via a cable to a head control substrate (not shown) mounted on the printing apparatus 1. Furthermore, the wiring substrate 102 is electrically connected via the flexible cables 103 to the print element substrate 101 illustrated in FIG. 4. Accordingly, supply of power is performed via the cables. A common power supply voltage is supplied from a common power supply voltage input terminal 401 (a power supply input terminal), divided in the wiring substrate 102, and supplied to a digital circuit power supply terminal 301 and an analog circuit power supply terminal 302 of the print element substrate 101. Accordingly, the wiring substrate 102 has a power supply output terminal 406 for output that is connected to the digital circuit power supply terminal 301, and a power supply output terminal 407 for output that is connected to the analog circuit power supply terminal 302. Note that, in order to connect terminals of the print element substrate 101 and the wiring substrate 102 to each other, the flexible cables 103 comprise a power supply wiring line and a ground wiring line for analog, and a power supply wiring line and a ground wiring line for digital.

A ground voltage is supplied from a ground voltage input terminal 402 of the wiring substrate 102, and is connected to ground voltage input terminals 304 of the print element substrate 101. Accordingly, the wiring substrate 102 has ground voltage output terminals 408 that are connected to ground voltage input terminals of the print element substrate 101.

Data is inputted to a data input terminal 305 of the print element substrate 101 via a data input terminal 405 of the wiring substrate 102. Accordingly, the wiring substrate 102 has a data output terminal 409 that is connected to the data input terminal 305 of the print element substrate 101.

An analog circuit control terminal 403 of the wiring substrate 102 is connected to a control terminal 303 of the print element substrate 101. Therefore, the wiring substrate 102 is connected to the control terminal 303 of the print element substrate 101, and has a signal output terminal 410 for outputting a control signal. The flexible cables 103 further comprise a control signal wiring line for transferring a control signal.

Note that data inputted to the data input terminal 405 or a control signal inputted to the analog circuit control terminal 403 is transferred from the printhead control unit 644 illustrated in FIG. 2. As a counter-measure for a malfunction due to noise in the wiring substrate 102, a capacitor 404 is provided between the common power supply voltage wiring line and the ground voltage wiring line.

Figure 4:
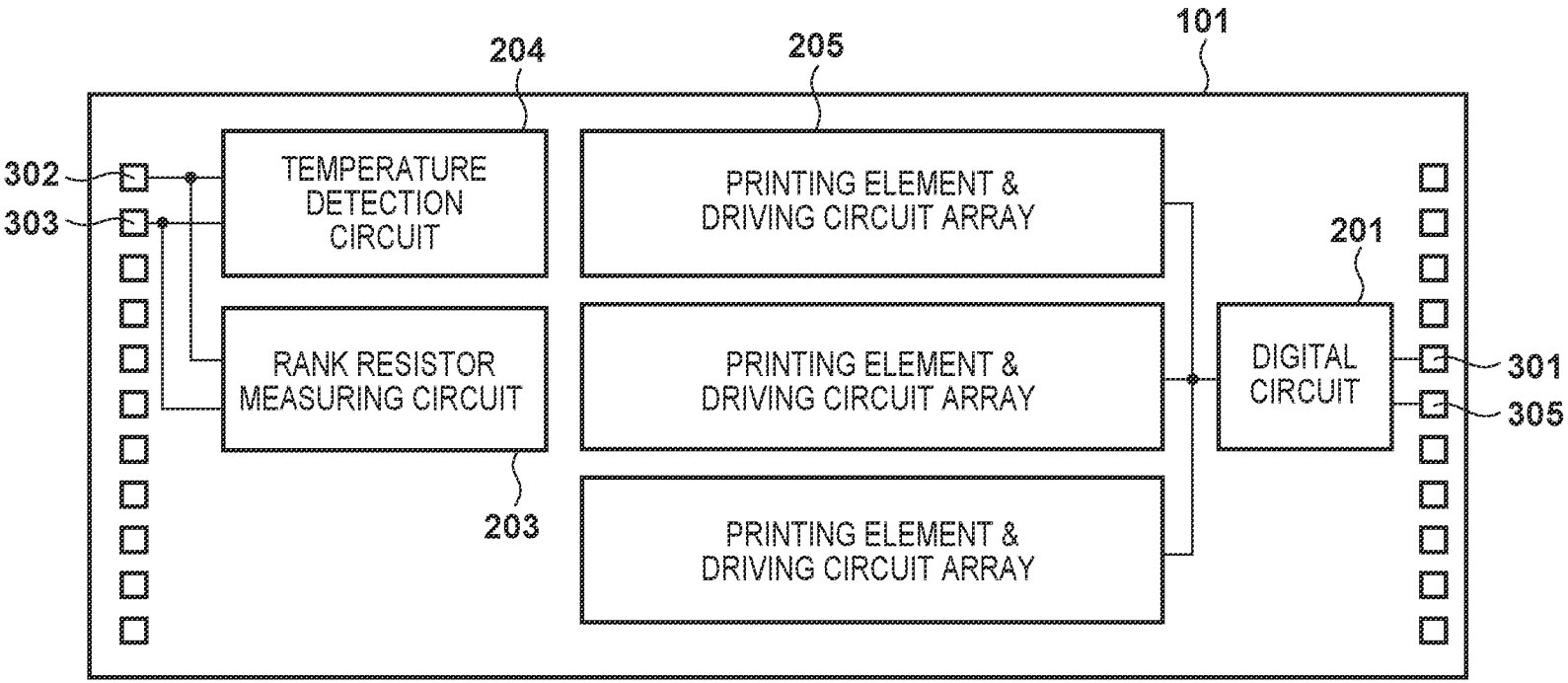
FIG. 4 is a view illustrating an example of a configuration of the print element substrate according to the first embodiment.

FIG. 4 illustrates an example of a configuration of the print element substrate 101 according to the first embodiment of the present invention. A plurality of print element arrays and corresponding driving circuit arrays (hereinafter one print element array and a corresponding driving circuit array are referred to together as a circuit array 205) are arranged in the print element substrate 101. In correspondence with a printing element, a driving circuit is provided with a driver for driving the printing element. The driver is a MOS transistor, for example. Three circuit arrays 205 are illustrated here, but there is no limitation to this. There may be one, two, four, or six circuit arrays 205, for example. Data transmitted from the wiring substrate 102 is inputted to the data input terminal 305, processed by a digital circuit 201, and transmitted (supplied) to each of the circuit arrays 205. When a driving circuit corresponding to the data is driven, a current flows to a corresponding printing element, and ink (a recording material) in accordance with the energy of the current is discharged (not shown) to a print medium P.

The digital circuit 201 is mainly configured by a group of circuits, such as a latch circuit and a shift register circuit, that holds received data, and is connected to the digital circuit power supply terminal 301. In the present embodiment, a rank resistor measuring circuit 203 or a temperature detection circuit 204 are arranged as an analog circuit 202. The rank resistor measuring circuit 203 is used to measure a resistance value of a printing element in the print element substrate 101, or an ON resistance value of the driver for driving the printing element. The temperature detection circuit 204 is used to monitor a temperature in the print element substrate 101. The analog circuit power supply terminal 302 is connected to the rank resistor measuring circuit 203 and the temperature detection circuit 204. The control terminal 303, which is for stopping operation of a partial circuit of the analog circuit 202, is connected to the rank resistor measuring circuit 203 and the temperature detection circuit 204. The rank resistor measuring circuit 203 has a configuration illustrated in FIG. 5 and FIG. 16A. A rank resistor is connected to a terminal INP. A voltage applied to this rank resistor is inputted to an operational amplifier circuit 207, and is outputted from the output terminal OUT after being amplified by the operational amplifier circuit 207. A configuration of a non-inverting amplifier is taken in which an inverted input terminal of the operational amplifier circuit 207 is connected to ground via R1, and the output of the operational amplifier circuit 207 is fed back to the inverted input terminal via R2. The gain of the non-inverting amplifier is 1+R2/R1, and is determined by the ratio of the resistors. Similarly, the temperature detection circuit 204 also has the configuration illustrated in FIG. 5 and FIG. 16A. A diode (a sensor) is connected to the terminal INP. A voltage of the diode is inputted to the operational amplifier circuit 207, and is outputted from the output terminal OUT after being amplified by the operational amplifier circuit 207.

As with the configuration of FIG. 3 and FIG. 4, in the print element substrate 101, the power supply wiring line for the digital circuit and the power supply wiring line for the analog circuit are provided separately. In the print element substrate 101, the power supply wiring line for the digital circuit and the power supply wiring line for the analog circuit are not connected. In this way, it is possible to prevent a malfunction due to electromagnetic noise by separating the digital circuit power supply wiring line and the analog circuit power supply wiring line. In addition, in the wiring substrate 102, the power supply wiring line for the digital circuit and the power supply wiring line for the analog circuit are connected, and the power supply terminal is shared. By such a configuration, it is possible to suppress a number of terminals of the printhead 100. Note that configuration may be taken to connect the digital circuit power supply wiring line and the analog circuit power supply wiring line in the case of a circuit in which there is no chance of a malfunction due to electromagnetic noise.

Figure 5:
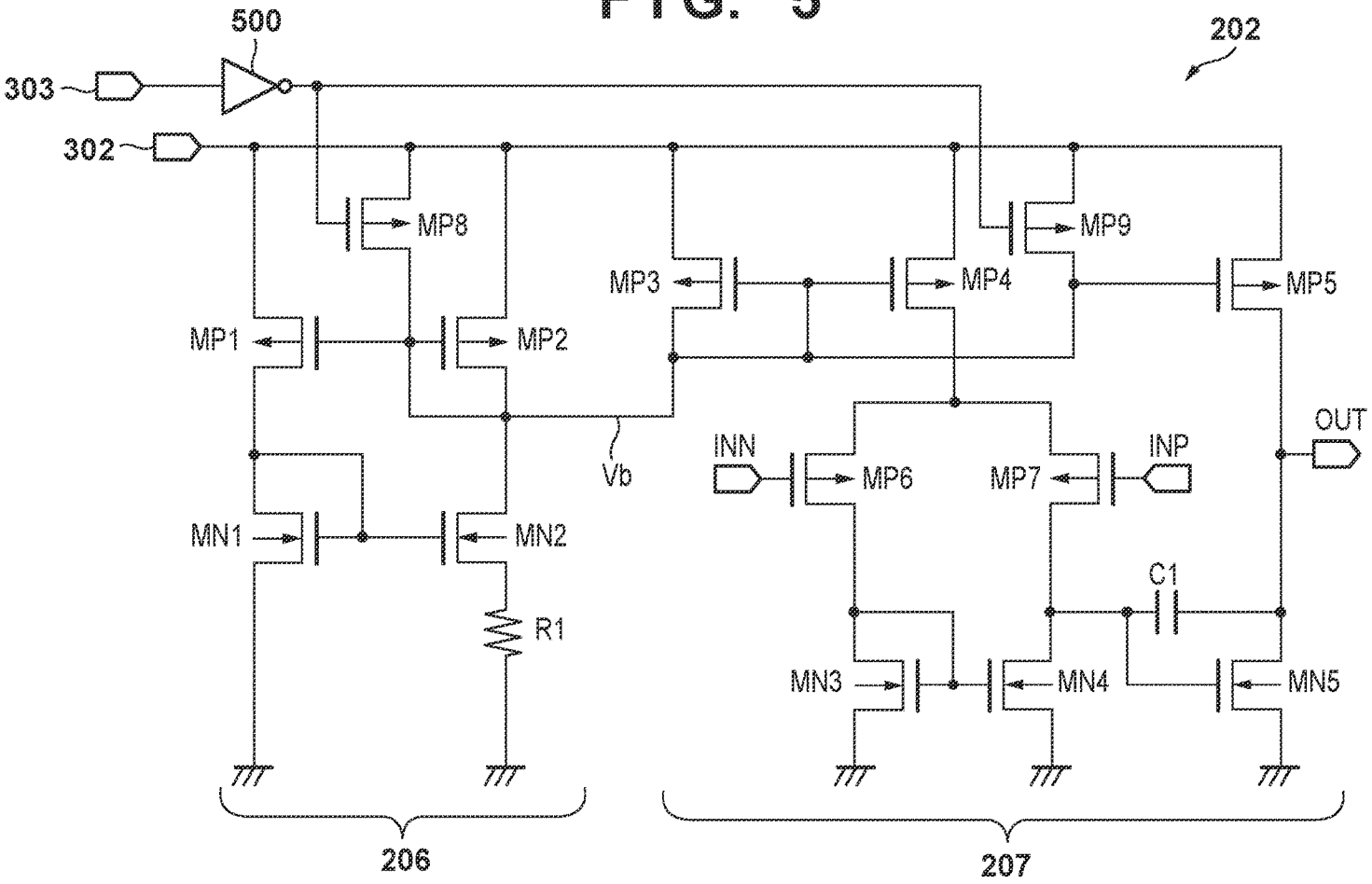
FIG. 5 is a circuit diagram illustrating an example of an analog circuit according to the first embodiment.

FIG. 5 illustrates an example of a configuration of the analog circuit 202 according to the first embodiment of the present invention. The analog circuit 202 of the present embodiment includes a logic circuit, and is configured by combining a bias circuit 206 and the operational amplifier circuit 207. The operational amplifier circuit 207 is an analog signal processing circuit that performs processing of an analog signal. When the bias circuit 206 is operating, a bias voltage Vb is supplied to the operational amplifier circuit 207. The operational amplifier circuit 207 operates by receiving the supply of the bias voltage Vb. When supply of the bias voltage Vb is stopped, the operational amplifier circuit 207 does not operate even if it is receiving a supply of power, and it is possible to suppress current consumption. In FIG. 5, MN indicates an NMOS transistor, and MP indicates a PMOS transistor. In addition, R1 indicates a resistor, and C1 indicates a capacitor. Note that detailed explanation regarding typical circuit operation of the bias circuit 206 and the operational amplifier circuit 207 is omitted. The bias circuit 206 and the operational amplifier circuit 207 are supplied with the analog circuit power supply (power) from the analog circuit power supply terminal 302. The drain of MP8 is connected to the gates of MP1 and MP2, and the analog circuit power supply terminal 302 is connected to the source of MP8. The drain of MP9 is connected to the gates of MP3, MP4, and MP5, and the analog circuit power supply terminal 302 is connected to the source of MP9.

When the analog circuit 202 is operating, current flows to the NMOS transistors and the PMOS transistors of the analog circuit 202. MP8 works as a switch for switching operation and stoppage of the bias circuit 206. MP9 works as a switch for switching operation and stoppage of the operational amplifier circuit 207. A NOT circuit 500 for inverting an input from the control terminal 303 is connected to the gates of MP8 and MP9.

When the power supply switch 621 described above is turned on, an analog voltage is supplied from the power supply circuit to the analog circuit 202. In this state, when a high (H) level control signal is inputted to the control terminal 303, a low (L) level signal is inputted to the gate of MP8. By this, MP8 enters an on state. By this, because a power supply (the H-level) is connected to the gates of MP1 through MP5, MP1 through MP5 are in an off state. Accordingly, the bias circuit 206 does not operate (stops). Similarly, when a high (H) level control signal is inputted to the control terminal 303, MP9 enters an on state, and the operational amplifier circuit 207 does not operate (stops). The high (H) level control signal is a signal for instructing stoppage of the analog circuit 202. Meanwhile, the low (L) level control signal is a signal for instructing the analog circuit 202 to start. To use a different expression, the high (H) level control signal is a signal for instructing supply stoppage of the bias voltage. In contrast, the low (L) level control signal is a signal for starting supply of the bias voltage. In this way, while an analog voltage is being supplied to the analog circuit, if the state of the control terminal 303 changes from the high level to the low level, the bias circuit 206 and the operational amplifier circuit 207 transition from a stopped state to an operational state.

In this way, an amount of time required for activation of the analog circuit 202 in accordance with switching of the control signal is shorter than an amount of time required for activation of the analog circuit 202 when it is supplied with the analog voltage by the power supply switch 621 being turned on. Conventionally, when an analog circuit power supply (power) is supplied, the analog circuit 202 would operate and thus consume power. However, by the configuration illustrated in FIG. 5, the analog circuit 202 does not operate even if supplied with power for the analog circuit, and thus it is possible to suppress power consumption.

Figure 6:
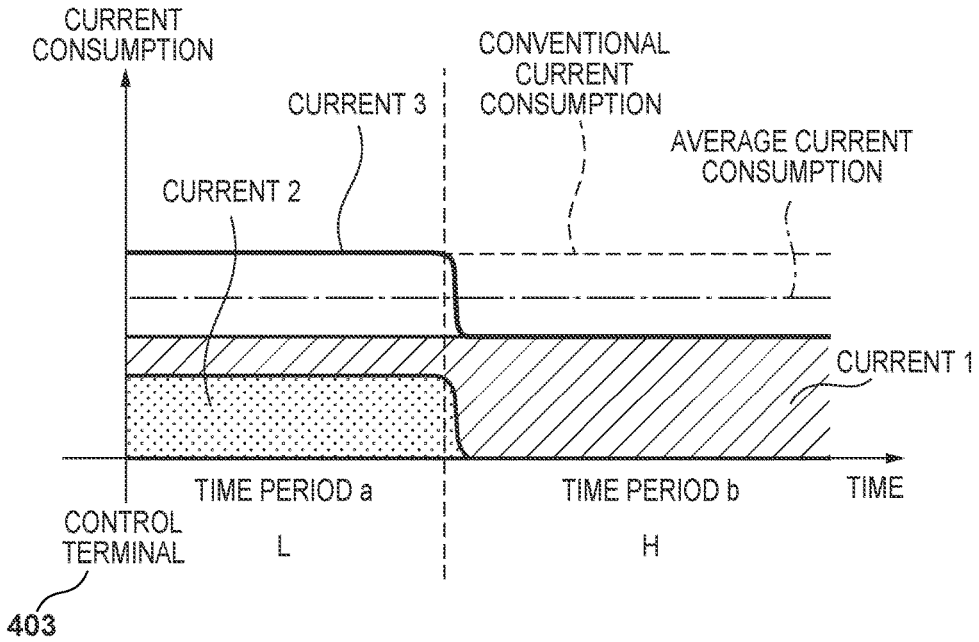
FIG. 6 is a graph of current consumption by the printhead according to the first embodiment.

FIG. 6 illustrates a graph of current consumption by the printhead 100 according to the first embodiment of the present invention. In FIG. 6, the ordinate indicates current consumption, and the abscissa indicates time. The configuration of the printhead 100 and the print element substrate 101 is explained by the configuration illustrated by FIG. 3 through FIG. 5.

In a time period a, printing and temperature detection are performed simultaneously. A current 1 is consumed in the digital circuit 201 by a circuit operation such as a data transfer. In addition, an L signal is inputted to the analog circuit control terminal 403 of the printhead 100, and an L signal is inputted to the control terminal 303 of the print element substrate 101. When the L signal is inputted to the control terminal 303, an H signal is inputted to the gates of MP8 and MP9 by the NOT circuit 500 as illustrated in FIG. 5, and the PMOS transistors do not operate. In such a case, the analog circuit 202 operates as the normal bias circuit and the operational amplifier circuit, and a current 2 is consumed. As a result, a current 3 that flows to the wiring substrate 102 is the sum of the current 1 and the current 2.

Meanwhile, in a time period b only printing is performed, and temperature detection is not performed. The current 1 continues to flow in the digital circuit 201 in accordance with a circuit operation such as a data transfer. In addition, an H signal is inputted to the analog circuit control terminal 403 of the printhead 100, and an H signal is inputted to the control terminal 303 of the print element substrate 101. When the H signal is inputted to the control terminal 303, an L signal is inputted to the gates of MP8 and MP9 by the NOT circuit 500 as illustrated in FIG. 5, and the PMOS transistors operate. When MP8 and MP9 operate, the gates of MP1 and MP2 are connected to the analog circuit power supply terminal 302 via MP8, and the gates of MP3, MP4, and MP5 are connected to the analog circuit power supply terminal 302 via MP9. Because MP1 through MP5 are PMOS, operation stops when H is inputted to the gates, and the bias circuit 206 and the operational amplifier circuit 207 do not consume current. As described above, in the time period b, because current consumption by the bias circuit 206 and the operational amplifier circuit 207 is suppressed, the current 3 that flows to the wiring substrate 102 is only the current 1 for printing.

By the foregoing configuration, it is possible to reduce average current consumption of the print element substrate 101 over the time periods a-b. Illustration is given in FIG. 6 together with conventional current consumption.

By the above, because current consumption by the analog circuit 202 is suppressed in a configuration where the digital circuit power supply and the analog circuit power supply in the printhead 100 are shared, it is possible to reduce average current consumption over the time period a and the time period b.

Figure 7:
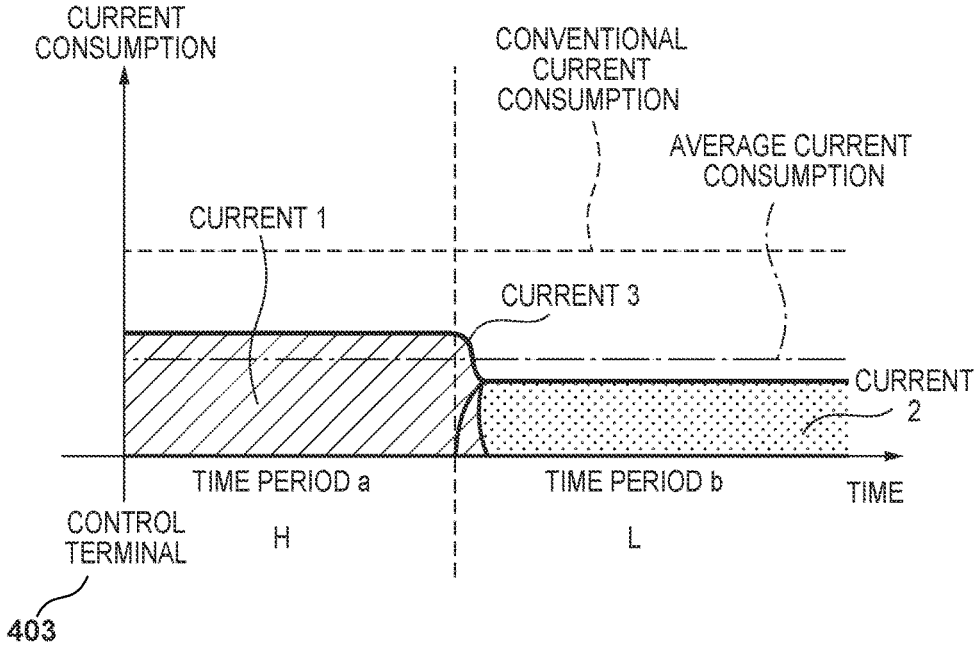
FIG. 7 is a graph of current consumption by the printhead according to the first embodiment.

In addition, in a case of performing temperature detection after printing without performing temperature detection in a printing time period, a signal provided to the analog circuit control terminal 403 may be set to H in the time period a (a time of printing) and L in the time period b (a time of no printing), as illustrated in FIG. 7. In this case, only the current 1 which is necessary for printing is consumed in the time period a, and operation of the analog circuit 202 stops without temperature detection being performed. In the time period b, printing is not performed, and the current 2 necessary for the operational amplifier circuit 207 and the bias circuit 206 for causing the analog circuit 202 to operate is consumed. The current that flows to the wiring substrate 102 is as with the current 3 (bold line) indicated in FIG. 7, and it is possible to further reduce average current consumption, with respect to FIG. 6.

In the present embodiment, illustration is given for a configuration in which the analog circuit power supply terminal 302 is connected to MOS transistor gates via the MP8 and MP9 transistors, but another configuration may be taken. For example, a configuration in which a MOS transistor is provided between the analog circuit power supply terminal 302 and the source of each PMOS (MP1 through MP5), and the gate of the arranged MOS transistor is controlled by a control terminal may be considered. In addition, consideration may be given to a configuration in which a MOS transistor is provided between the ground voltage input terminals 304 and the source of each NMOS (MN1 through MN5), and the gate of the arranged MOS transistor is controlled by a control terminal. In addition, a configuration in which the input terminals INN and INP of the operational amplifier circuit 207 are connected to the analog circuit power supply terminal 302 via a MOS transistor may be considered.

Figure 17:
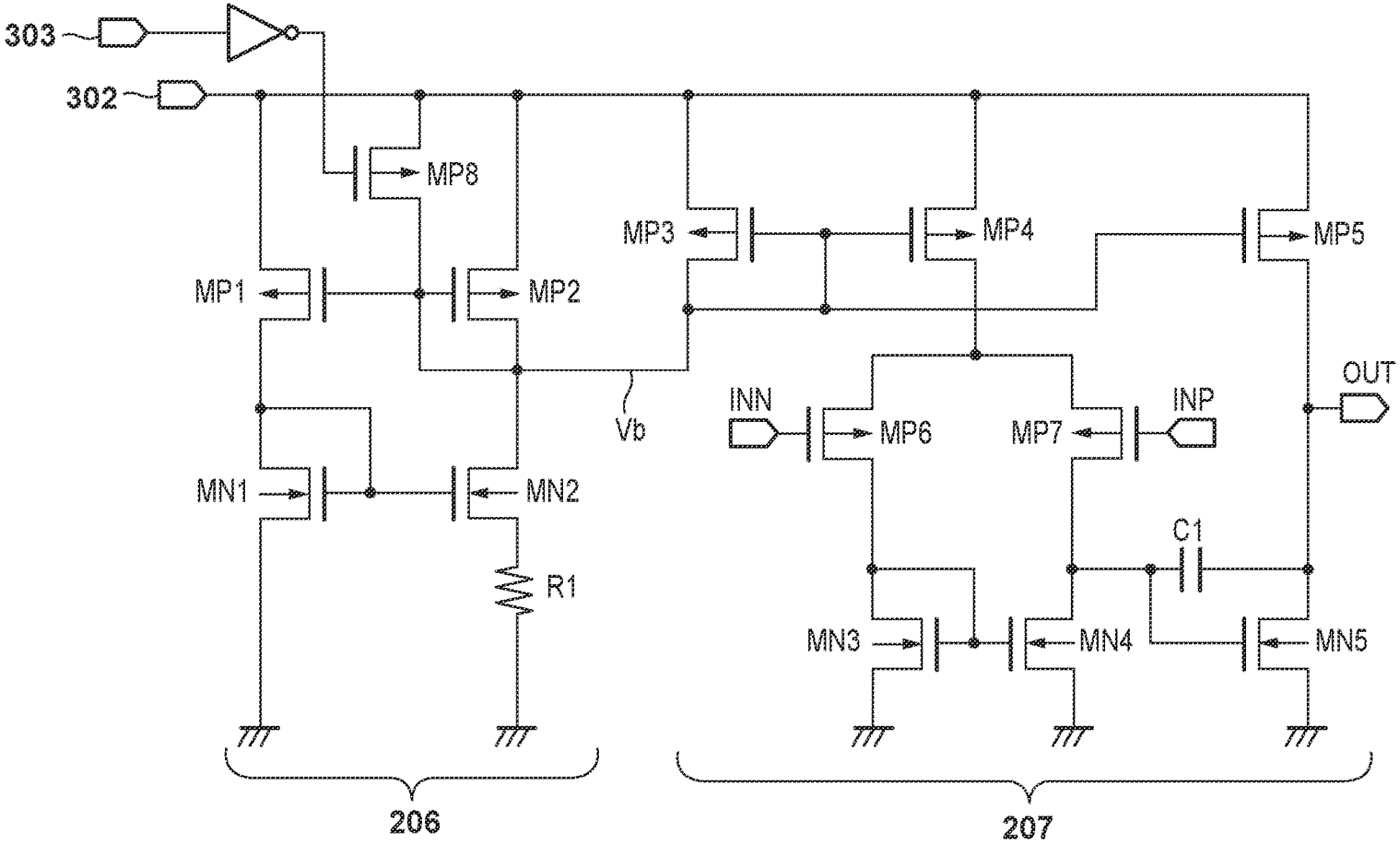
FIG. 17 is a view illustrating a variation of an analog circuit according to the first embodiment.
Figure 18:
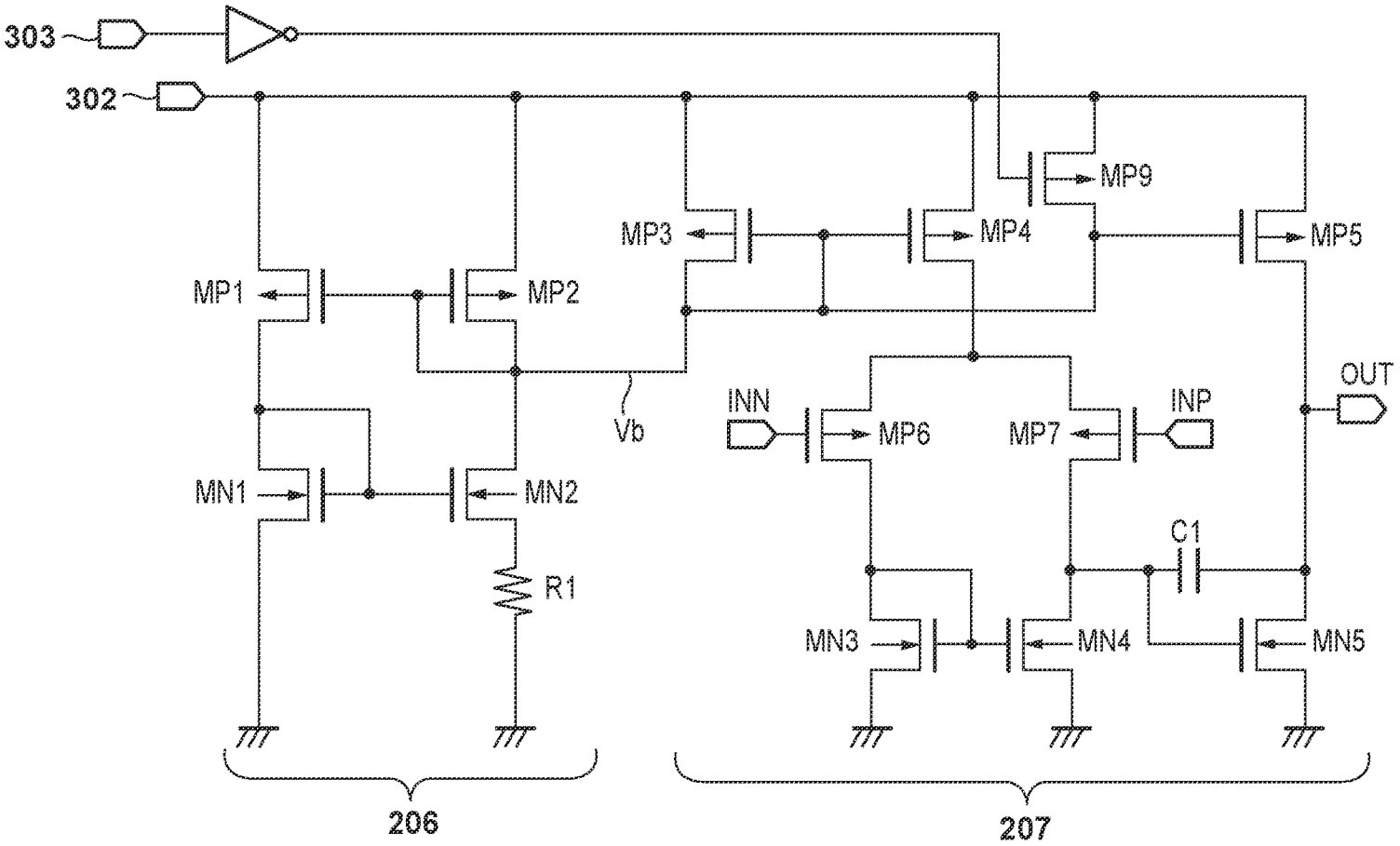
FIG. 18 is a view illustrating a variation of an analog circuit according to the first embodiment.

In addition, it is not necessary to connect the control terminal 303 to all circuits in the analog circuit 202, and the control terminal 303 may be connected to only circuits for which stopping operation thereof is desired. In FIG. 17, the control terminal 303 is connected to the bias circuit 206, but the control terminal 303 is not connected to the operational amplifier circuit 207. A difference with FIG. 5 is that MP9 is omitted from the operational amplifier circuit 207. By omitting MP9, it is possible to have the analog circuit 202 be more compact. In FIG. 18, the control terminal 303 is connected to the operational amplifier circuit 207, but the control terminal 303 is not connected to the bias circuit 206. A difference with FIG. 5 is that MP8 is omitted from the operational amplifier circuit 207. By omitting MP8, it is possible to have the analog circuit 202 be more compact. In this circuit, the high (H) level control signal is a signal for instructing stoppage of the operational amplifier circuit 207. Meanwhile, the low (L) level control signal is a signal for instructing the operational amplifier circuit 207 to start. In this case, the current 2 illustrated in FIG. 6 and FIG. 7 does not completely become zero, and current is suppressed proportionally to the circuit for which operated is stopped. In addition, in a case where many more circuits are included in the analog circuit 202, control may be performed to switch stoppage/operation for only a portion out of this plurality of circuits.

In addition, a signal inputted to the analog circuit control terminal 403 of the printhead 100 may be switched between a time of a test mode and a time of waiting in correspondence with operation of the printing apparatus, in addition to switching between printing and no printing.

In addition, the analog circuit 202 is explained by the bias circuit 206 and the operational amplifier circuit 207. There is no necessity to only have such a configuration, and a band gap circuit, a comparator, or the like may be used instead of the operational amplifier circuit 207. In addition, it is not necessary for a purpose of the analog circuit 202 to be only a rank resistor measuring circuit or a temperature detection circuit, and the analog circuit 202 may be a digital-analog conversion electric circuit, a DC-DC converter circuit, or the like.

Figure 16A:
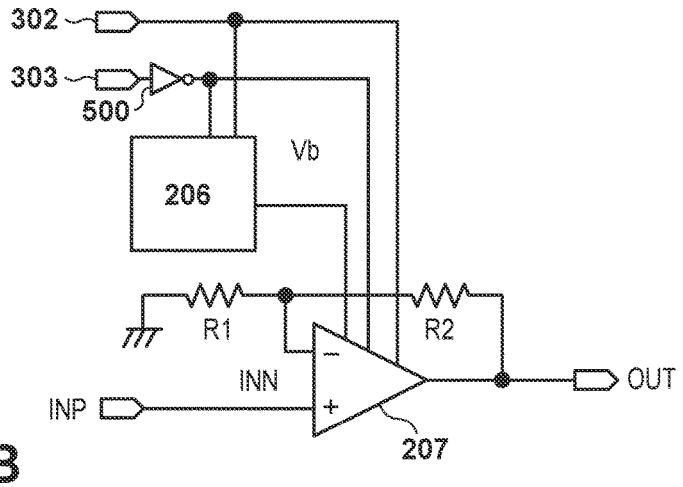
FIGS. 16A, 16B, and 16C are views illustrating examples of configurations of analog circuits according to the first embodiment.
Figure 16B:
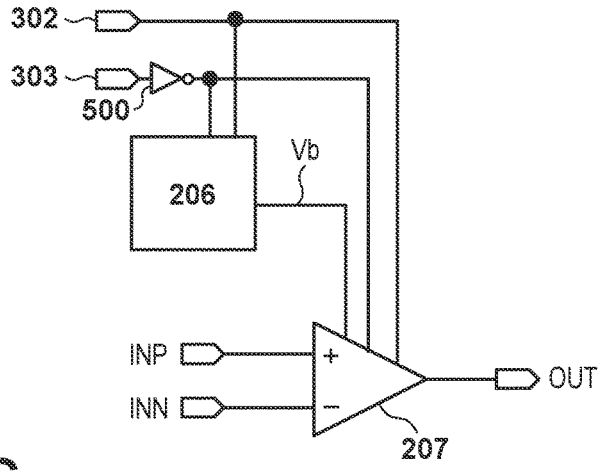
Figure 16C:
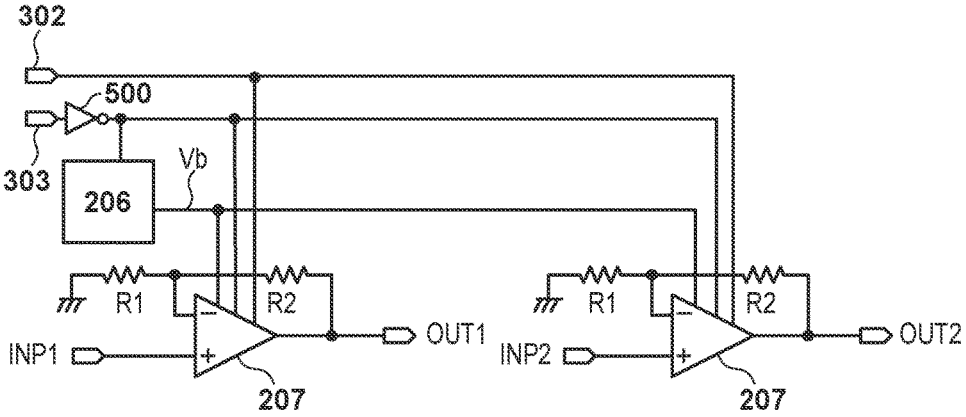

Note that, a configuration of the analog circuit 202 may be, for example, a configuration in which a plurality of operational amplifier circuit 207 are connected to one bias circuits 206 as illustrated in FIG. 16C. In such a case the bias voltage Vb is supplied to each operational amplifier circuit 207.

Second Embodiment

Figure 8:
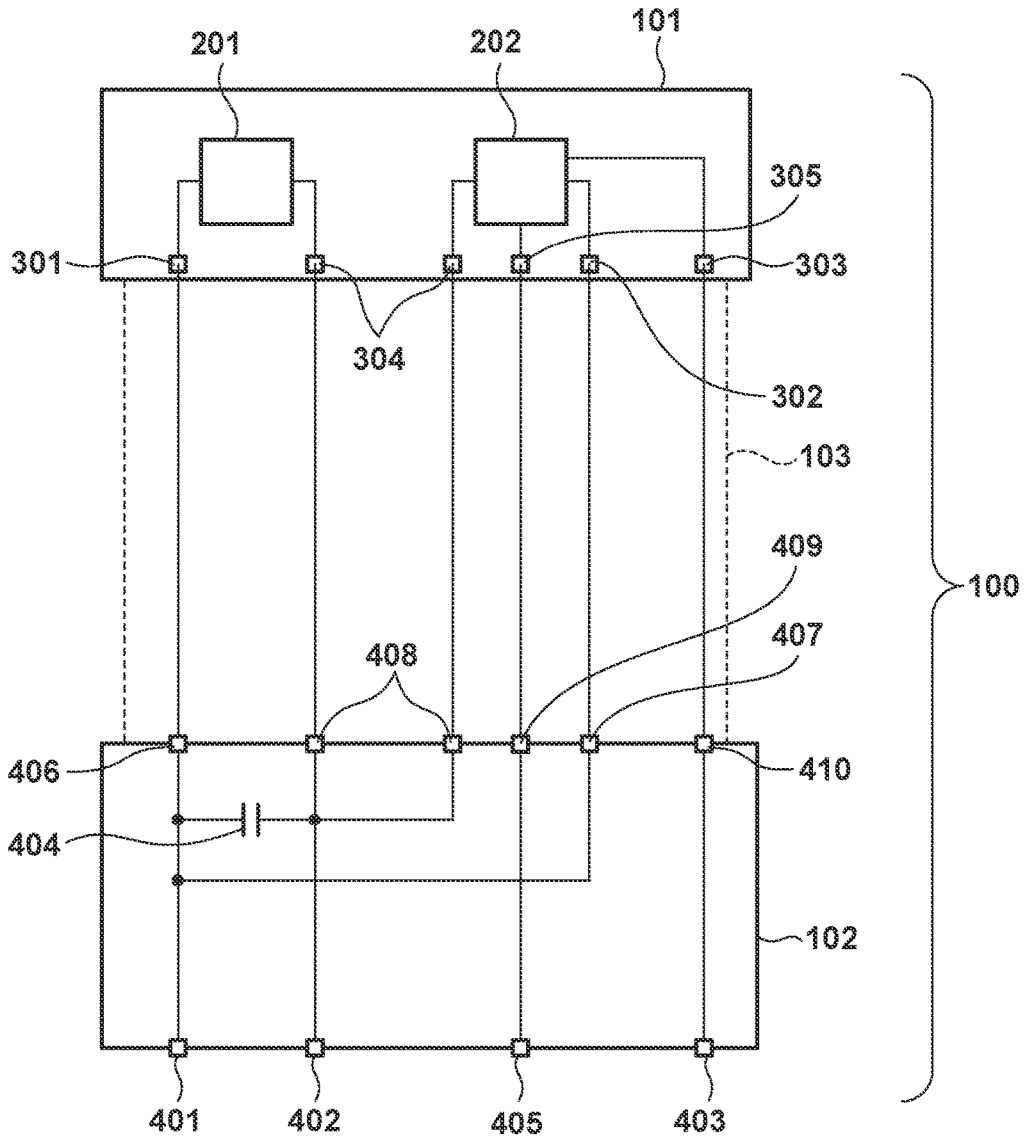
FIG. 8 is a view illustrating an example of a configuration of the printhead according to a second embodiment.
Figure 9:
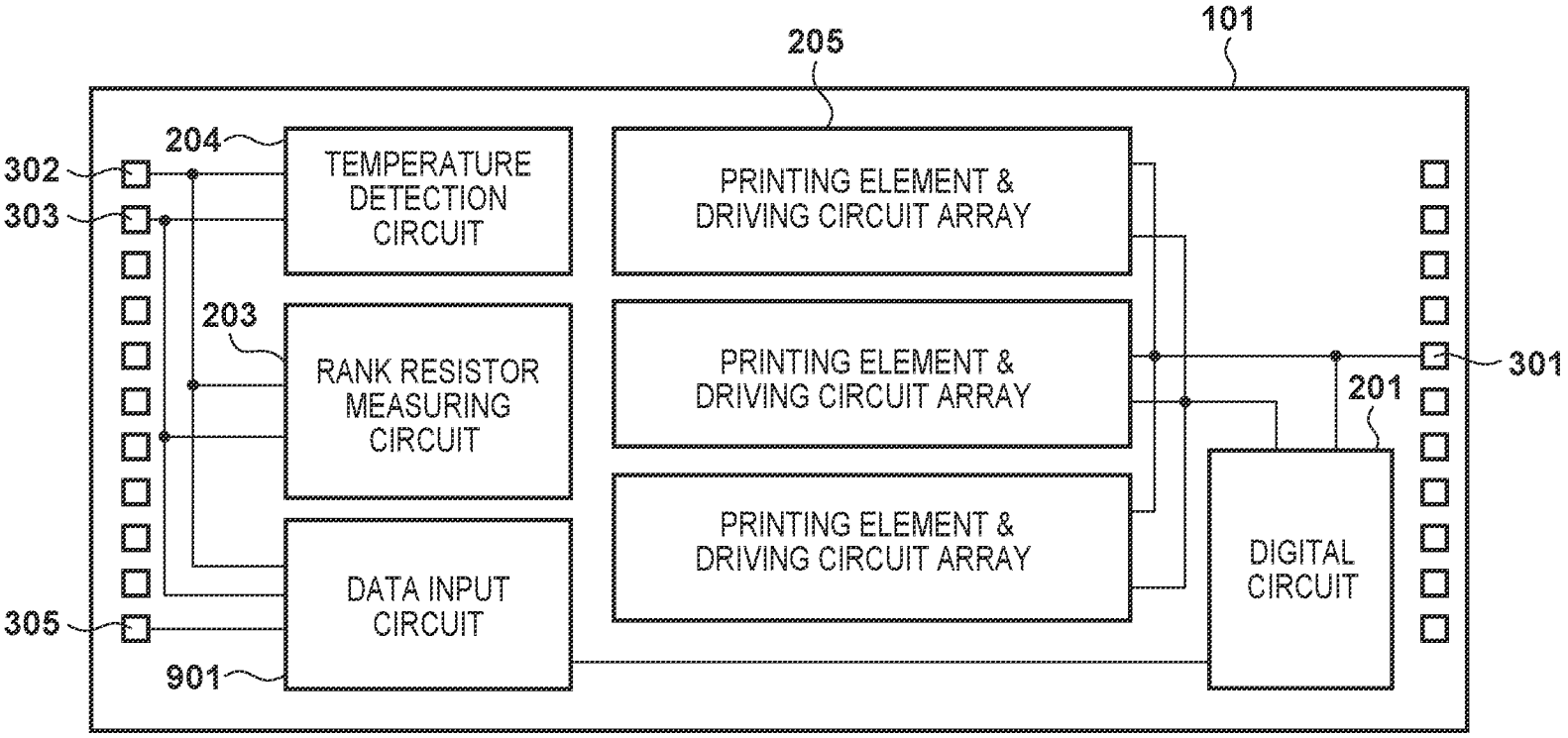
FIG. 9 is a view illustrating an example of a configuration of the print element substrate according to the second embodiment.

FIG. 8 illustrates an example of a configuration of the printhead 100 according to a second embodiment of the present invention. FIG. 9 illustrates an example of a configuration of the print element substrate 101 according to the second embodiment of the present invention. Explanation is omitted for details similar to those of the first embodiment. A difference with the first embodiment is that the data input terminal 405 of the wiring substrate 102 is connected to the analog circuit 202 via the data input terminal 305 of the print element substrate 101.

As in FIG. 9, a data input circuit 901 that processes data inputted to the print element substrate 101 is connected to the analog circuit power supply terminal 302. The data input circuit 901 includes an operational amplifier, a bias circuit, a current mirror circuit used for these, or the like, and is separated from the digital circuit power supply in order to prevent noise for a digital circuit such as a shift register from overlapping. The digital circuit power supply and the analog circuit power supply have the same voltage, and data processed by the data input circuit 901 is outputted to the digital circuit 201 that is connected to the digital circuit power supply terminal 301, and is transmitted to a corresponding print element array. The analog circuit 202 (the rank resistor measuring circuit 203, the temperature detection circuit 204, and, the data input circuit 901) is connected to the analog circuit power supply terminal 302.

The data input (reception) circuit 901 is connected to the analog circuit power supply terminal 302. By this, by the analog circuit control terminal 403, it is possible to suppress consumed current that flows to the analog circuit 202, which includes the data input circuit 901 in addition to the rank resistor measuring circuit 203 and the temperature detection circuit 204. If the data input circuit 901 is not operating, the print element substrate 101 will not store data in a shift register even if data is inputted (received). By this, even if a CLK or data is transmitted at an incorrect timing, the print element substrate 101 will not receive it, and it is possible to suppress current consumption and prevent a malfunction.

Third Embodiment

Figure 10:
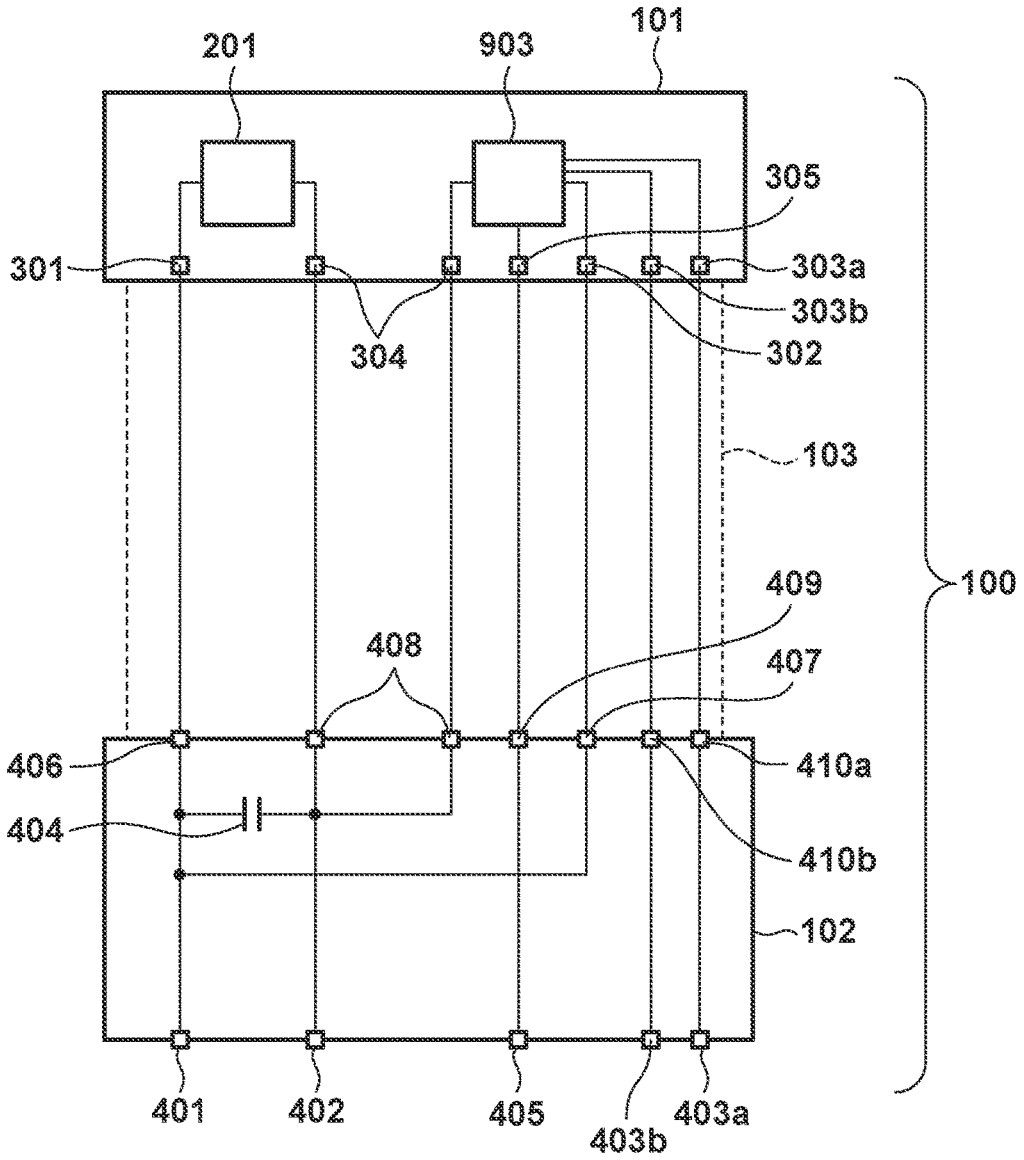
FIG. 10 is a view illustrating an example of a configuration of the printhead according to a third embodiment.
Figure 15:
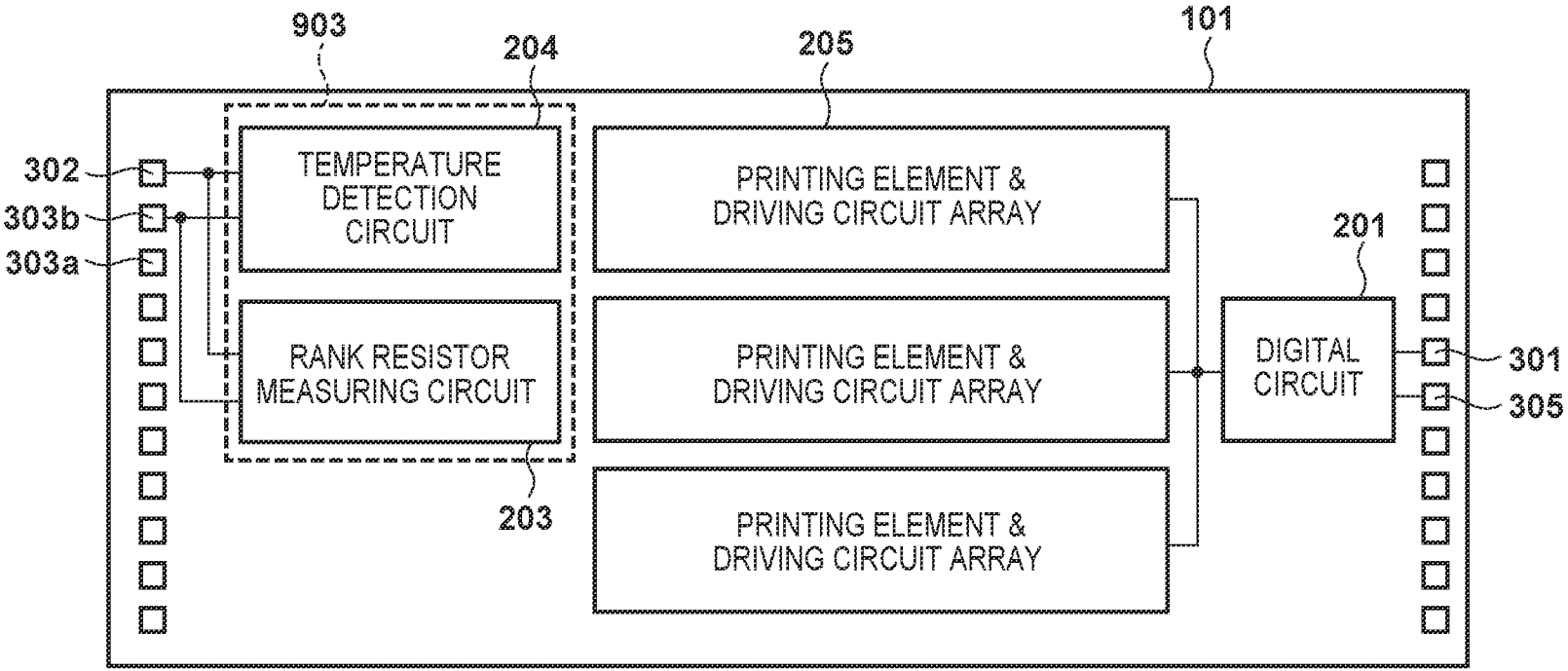
FIG. 15 is a view illustrating an example of a configuration of the printhead according to the third embodiment.

FIG. 10 and FIG. 15 illustrate an example of a configuration of the printhead 100 according to a third embodiment of the present invention. Explanation is omitted for details similar to those of the first and second embodiments. The circuit 903 has the rank resistor measuring circuit 203 and the temperature detection circuit 204. The wiring substrate 102 is provided with two analog circuit control terminals 403-*a* and 403-*b*, and signal output terminals 410-*a* and 410-*b* that correspond thereto. In addition, the print element substrate 101 has a plurality of control terminals 303-*a* and 303-*b*. In FIG. 15, the control terminal 303-*a* is connected to the rank resistor measuring circuit 203. The control terminal 303-*b* is connected to the temperature detection circuit 204. When configuration is taken such that the rank resistor measuring circuit 203 measures every set durability count worth of printing whereas the temperature detection circuit 204 needs to continuously monitor during printing or not during printing, a large difference in frequency of usage arises.

It is desirable for the rank resistor measuring circuit 203 to be always set to off when unused because it has a low frequency of usage, and it is desirable for the temperature detection circuit 204 to be constantly set to on because it has a high frequency of usage. In this way, because the frequency of usage differs for each circuit even though they are both connected to the analog circuit power supply terminal 302, a plurality of the analog circuit control terminals 403-*a* and 403-*b* are provided, and control terminals are used after combining by frequency of usage. By this, the plurality of analog circuits are selectively caused to stop.

Figure 11:
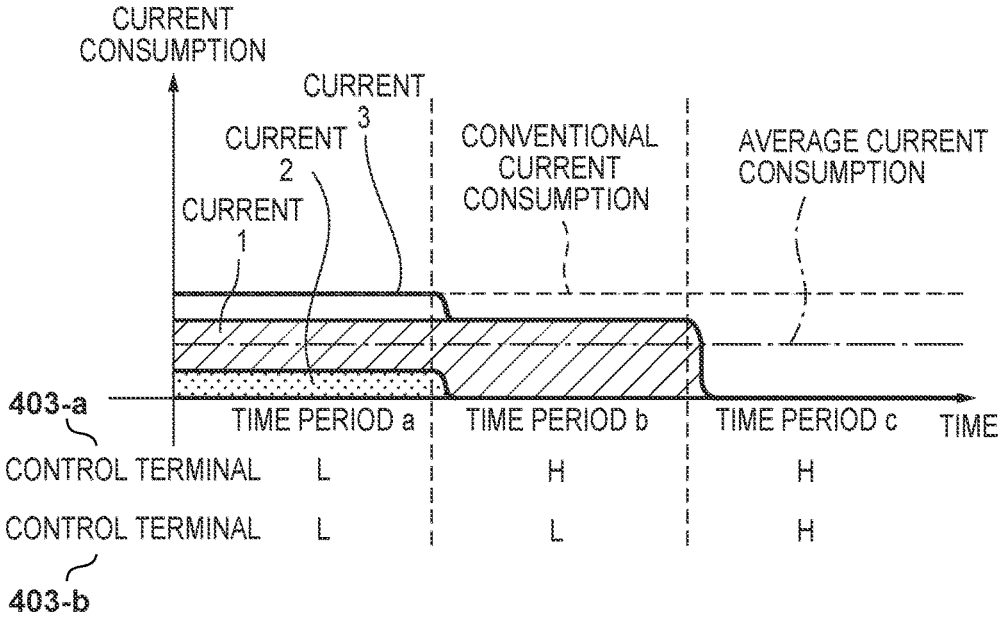
FIG. 11 is a graph of current consumption by the printhead according to the third embodiment.

FIG. 11 is a graph illustrating current consumption according to the present embodiment. In FIG. 11, the ordinate indicates current consumption, and the abscissa indicates time. Specifically, as in FIG. 11, when the analog circuit control terminals 403-*a* and 403-*b* are L (the time period a), the temperature detection circuit 204 and the rank resistor measuring circuit 203 operate normally and consume the current 1 and the current 2. When the analog circuit control terminal 403-*a* is H and the analog circuit control terminal 403-*b* is L (the time period b), the temperature detection circuit 204 operates normally and consumes the current 1, while the current 2 that would flow to the rank resistor measuring circuit 203 is suppressed. When the analog circuit control terminals 403-*a* and 403-*b* are H (a time period c), the current 1 and the current 2 that would flow to the temperature detection circuit 204 and the rank resistor measuring circuit 203 are suppressed. As a result, a current that flows to the wiring substrate 102 is as the current 3 illustrated in FIG. 11.

By virtue of the present embodiment, it is possible to control current consumption in more detail in comparison to the first and second embodiments. Note that, in the present embodiment, illustration was given of an example in which two control terminals were given as a plurality of control terminals, but control in further detail may be performed by providing even more control terminals.

Fourth Embodiment

Figure 12:
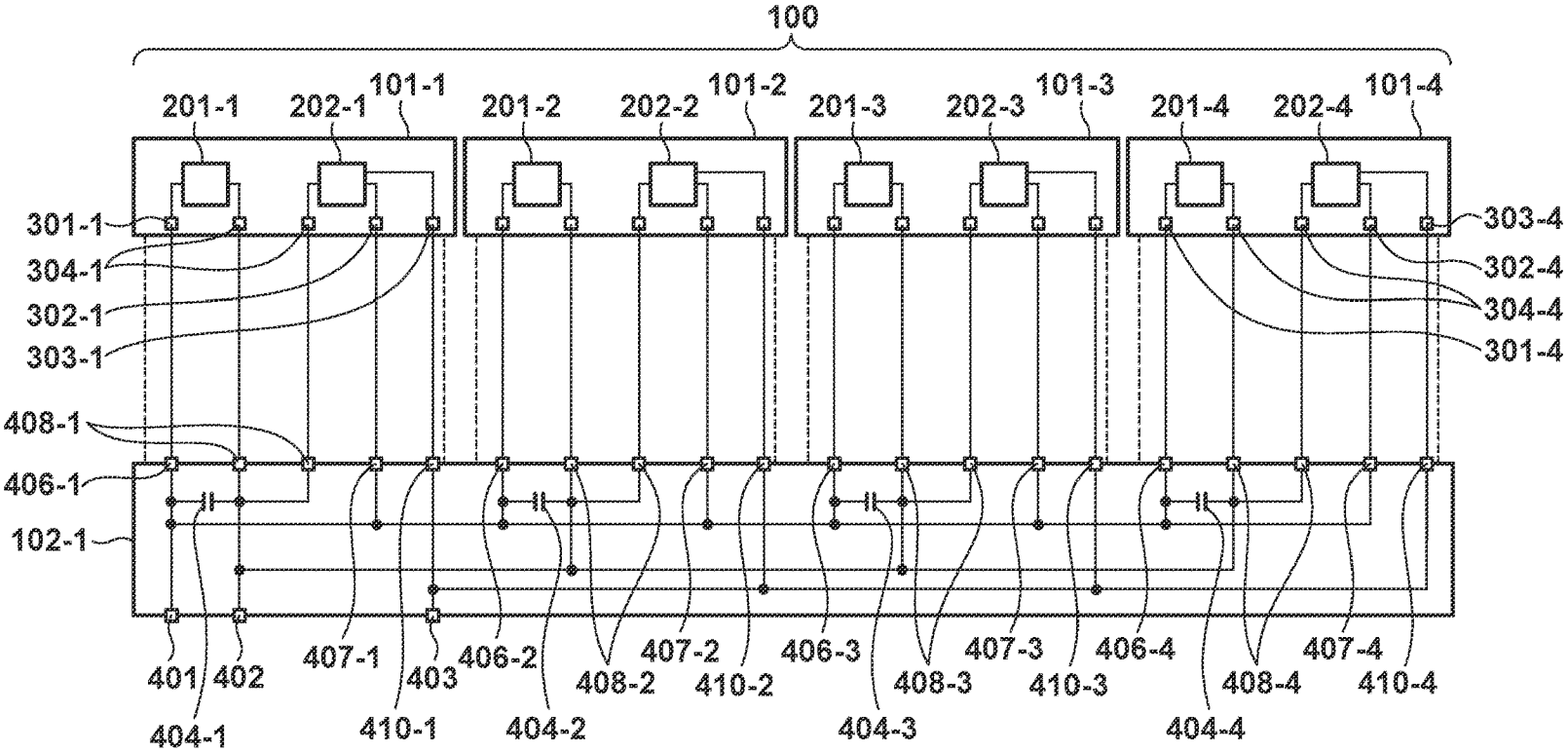
FIG. 12 is a view illustrating an example of a configuration of the printhead according to a fourth embodiment.

FIG. 12 illustrates an example of a configuration of the printhead 100 according to a fourth embodiment of the present invention. Explanation is omitted for details similar to those of the first through third embodiments.

The printhead 100 is a line head having a plurality of print element substrates 101, and explanation is given in the present embodiment by a case in which the printhead 100 has four print element substrates 101-1 through 101-4. These four print element substrates are arranged following a direction that intersects a conveyance direction of a print medium. In addition, each print element substrate 101 may have, as illustrated in the first and second embodiments, a configuration in which the data input terminal 305 is connected to the digital circuit 201 or a configuration in which the data input terminal 305 is connected to the analog circuit 202, and thus the data input terminal 305 is omitted from the figure.

A wiring substrate 102-1 is mutually connected to the four print element substrates 101-1 through 101-4 via the flexible cables 103. The common power supply voltage input terminal 401, the ground voltage input terminal 402, and the analog circuit control terminal 403 of the printhead 100 are all mutually connected in the wiring substrate 102-1.

When the printhead 100 is not in use, by setting the analog circuit control terminal 403 to on it is possible to suppress steady current consumption by the analog circuit 202 of each of the print element substrates 101-1 through 101-4. By this, it is possible to reduce average consumption of current that flows to the wiring substrate 102.

Note that there is no need to have four print element substrates 101 that are used in the printhead 100 as described earlier, and configuration is taken to have a number of print element substrates 101 that is necessary for a print width. In other words, illustration is given of an example in which there are four print element substrates, but there is no limitation to this, and it is possible to apply the invention of the present application even if the number of print element substrates is increased or decreased.

Figure 13:
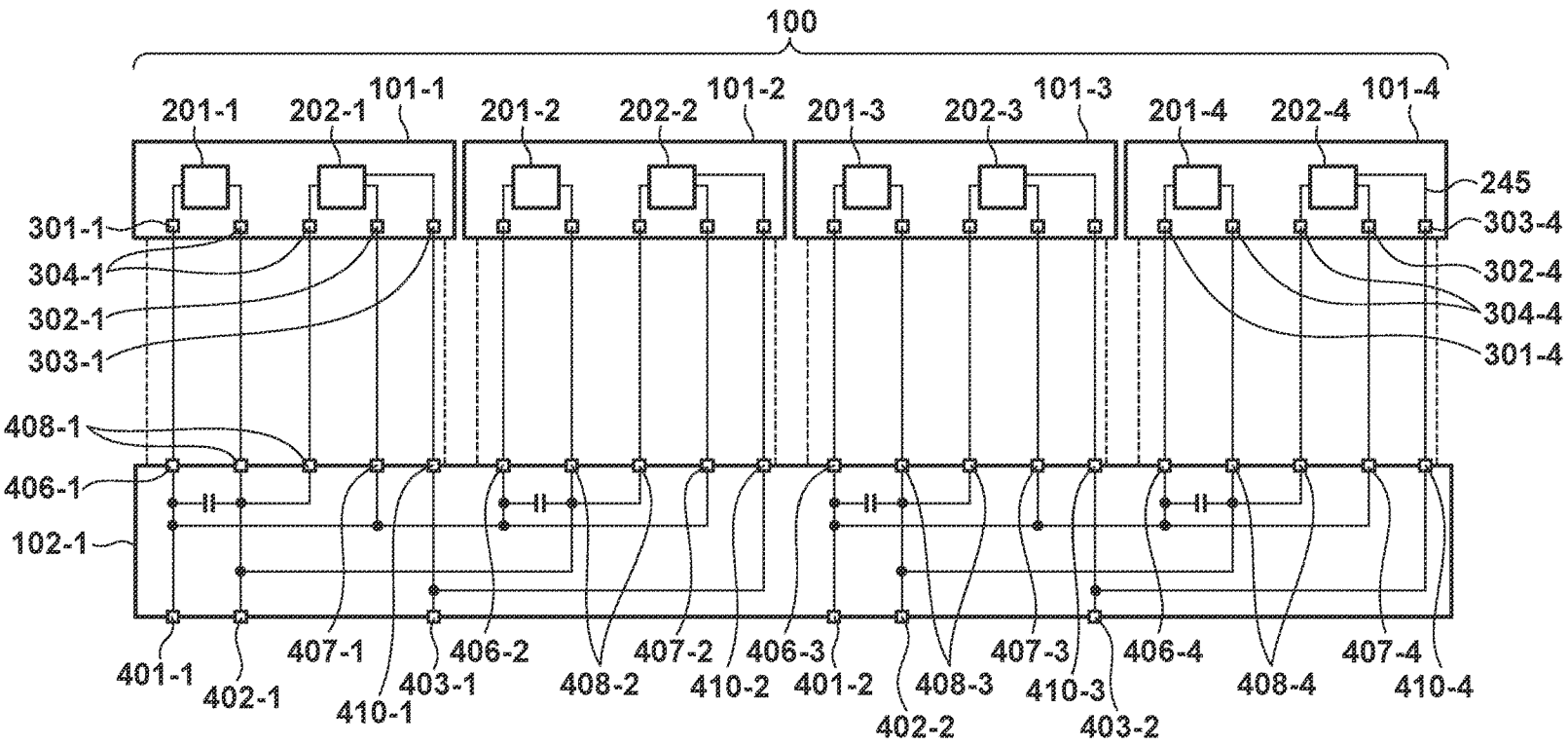
FIG. 13 is a view illustrating an example of a configuration of the printhead according to the fourth embodiment.

In addition, in a case such as that in which consumption current at a time of usage is high and power supply capacity is insufficient, as a counter-measure, the ground voltage input terminal 402 and the common power supply voltage input terminal 401 which are inputted to the wiring substrate 102 may be divided into a plurality of terminals as in FIG. 13. In comparison with the configuration of FIG. 12, the printhead has more common power supply voltage input terminals, ground voltage input terminals, and analog circuit control terminals. In contrast, a number of terminals for connections between the print element substrates 101 and the wiring substrate 102 is the same as in the configuration of FIG. 12. In such a case, the analog circuit control terminal 403 may be mutually connected to all four print element substrates 101, or a plurality of analog circuit control terminals 403 may be provided and separated for each print element substrate 101 similarly to the third embodiment in a case in which control is in more detailed regions.

As described above, by suppressing operation in accordance with a control terminal when not using an analog circuit, it is possible to reduce average current consumption, even for a line head type printhead.

Fifth Embodiment

Figure 14:
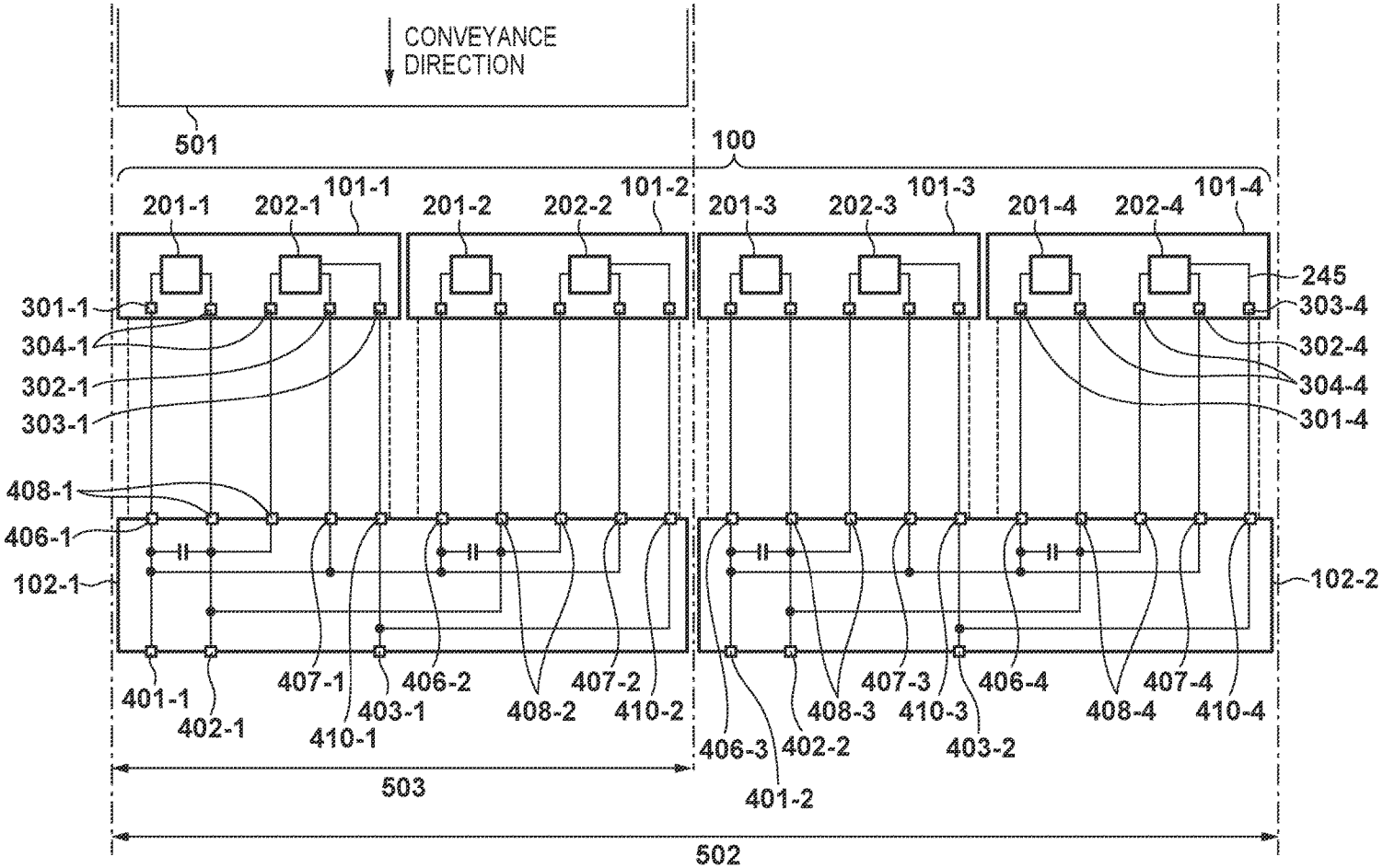
FIG. 14 is a view illustrating an example of a configuration of the printhead according to a fifth embodiment.

FIG. 14 illustrates an example of a configuration of a print element substrate according to a fifth embodiment of the present invention. Explanation is omitted for details similar to those of the first through fourth embodiments.

The wiring substrate 102-1 is connected to both of the print element substrate 101-1 which is first from the left of FIG. 14, and the print element substrate 101-2 which is second from the left. The wiring substrate 102-2 is connected to both of the print element substrate 101-3 which is third from the left of FIG. 14, and the print element substrate 101-4 which is fourth from the left. In other words a plurality (two here) of the print element substrates 101-1 and 101-2 is electrically connected to one wiring substrate 102-1. In other words a plurality (two here) of the print element substrates 101-3 and 101-4 is electrically connected to one wiring substrate 102-2. Accordingly, it is assumed that two groups are configured, and the groups in the printhead 100 are not electrically connected to one another.

The common power supply voltage input terminal 401, the ground voltage input terminal 402, and the analog circuit control terminal 403 of the printhead 100 are divided among each wiring substrate 102. The printhead 100 of the present embodiment has a print width 502 proportional to the length of four print element substrates 101, and a print medium 501 is printed on after being conveyed in a direction perpendicular to a direction in which the print element substrates 101 are consecutively arrayed. If the size of the print medium 501 which is printed on is smaller than the print width 502 by which printing by the printhead 100 is possible, it is not necessary to use all of the print element substrates 101. For example, if the print medium 501 is, as in FIG. 14, a width 503 that is half of the width of the printhead, the print element substrates 101-3 and 101-4 do not perform a print operation.

In the fourth embodiment, when a common power supply is being inputted to the common power supply voltage input terminal 401-2 of the printhead 100, consumed current will also steadily flow to the print element substrates 101 that are not in use. In the present embodiment, when the print medium 501 has the width 503 which is half of the print width 502 of the printhead 100, the analog circuit control terminal 403-2 is set to H to cause current consumption by the print element substrates 101-3 and 101-4 to be reduced. By this, it is possible to reduce steady current consumption by print element substrates 101 that are not in use.

Note that if there are a plurality of sizes for the print medium 501, it is also possible to provide a plurality of control terminals as in the third embodiment, and control suppression of current consumption by a combination of the control terminals.

By the above, in accordance with the present embodiment, it is possible to reduce current consumption by setting the control terminal of a print element substrate that will not be used in accordance with a print width to H.

Sixth Embodiment

Figure 19:
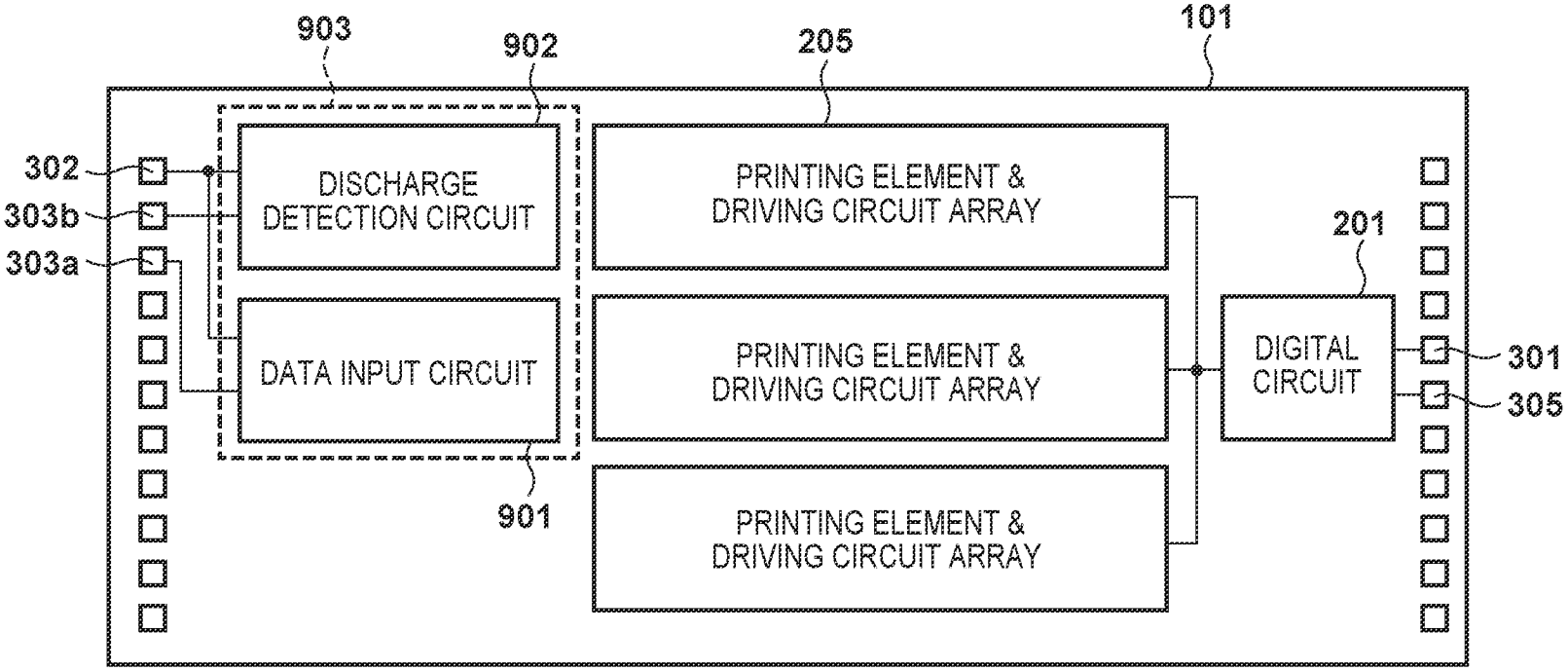
FIG. 19 is a view illustrating a variation of an analog circuit according to a sixth embodiment.

FIG. 19 illustrates a configuration of a print element substrate according to a sixth embodiment of the present invention. Explanation is omitted for details similar to those of the first through fifth embodiments.

In the sixth embodiment, the data input circuit 901 or a discharge detection circuit 902 are arranged as the analog circuit 202. A configuration of the data input circuit 901 according to the present embodiment is illustrated in FIG. 16B. The data input circuit 901 indicates an LVDS (low voltage differential signaling) reception circuit. The terminal INP corresponds to the non-inverted input terminal of the operational amplifier circuit 207 of FIG. 5, and receives a positive signal of a differential signal. The terminal INN corresponds to the non-inverted input terminal of the operational amplifier circuit 207 of FIG. 5, and receives a negative signal of the differential signal. The operational amplifier circuit 207 takes each differential to thereby output a single end signal from a terminal OUT.

At a time of printing for the printing apparatus, in accordance with a control signal, the data input circuit 901 enters a state in which it can receive a differential signal. Meanwhile, when the printing apparatus is not printing, the data input circuit 901 is caused to stop by the control signal.

A configuration of the discharge detection circuit 902 is illustrated in FIG. 16A. The discharge detection circuit 902 amplifies a voltage obtained from a sensor for discharge detection. The terminal INP corresponds to the terminal INP of the operational amplifier circuit 207 of FIG. 5, and receives the voltage obtained from the sensor for discharge detection. The operational amplifier circuit 207 outputs the amplified voltage from the output terminal OUT to a determination circuit (not shown), and it is determined whether discharging was performed successfully. The determination circuit may be arranged inside of the print element substrate as well as outside of the print element substrate via a terminal.

The discharge detection circuit 902 is caused to operate in accordance with a control signal when the printing apparatus performs a discharge detection. At other times, the discharge detection circuit 902 is caused to stop in accordance with the control signal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-001432, filed Jan. 6, 2017, which is hereby incorporated by reference herein in its entirety.

What is claimed is:

1. A printhead comprising:

a printing element;

a driving circuit configured to drive the printing element;

an analog signal processing circuit configured to process one or more analog signals;

a bias circuit configured to supply a bias voltage to the analog signal processing circuit; and a control terminal to which a control signal is inputted, wherein, in a state in which the analog signal processing circuit and the bias circuit are receiving a supply of power, it is possible to switch starting and stopping of at least one of the analog signal processing circuit and the bias circuit based on the control signal.

2. The printhead according to claim 1, wherein the bias circuit has a switch for switching starting and stopping of the bias circuit based on the control signal.

3. The printhead according to claim 1, wherein the analog signal processing circuit has a switch for switching starting and stopping of the analog signal processing circuit based on the control signal.

4. The printhead according to claim 1, wherein the printhead has a plurality of analog signal processing circuits, and the bias circuit supplies the bias voltage to the plurality of analog signal processing circuits.

5. The printhead according to claim 1, wherein the analog signal comprises at least one of a signal corresponding to a resistance value of the printing element, a signal corresponding to a temperature, a signal corresponding to an ON resistance value of a driver included in the driving circuit, and a differential signal.

6. The printhead according to claim 1, wherein the printhead further comprises a digital circuit configured to process a digital signal supplied to the driving circuit.

7. The printhead according to claim 1, wherein the analog signal processing circuit comprises at least one of a reception circuit configured to receive an LVDS signal, and a detection circuit configured to detect a discharge state of liquid in accordance with driving of the printing element.

8. The printhead according to claim 1,
further comprising at least one print element substrate, wherein
the at least one print element substrate comprises:
the printing element,
the driving circuit,
the analog signal processing circuit,
the bias circuit, and
the control terminal.

9. The printhead according to claim 1,
further comprising at least one print element substrate, wherein
the at least one print element substrate comprises:
an analog circuit that includes the analog signal processing circuit and the bias circuit,
a digital circuit configured to process a digital signal supplied to the driving circuit,
a first power supply terminal to which a first voltage is inputted,
a second power supply terminal to which a voltage equal to the first voltage is inputted,
a first power supply wiring line that connects the first power supply terminal and the analog circuit, and
a second power supply wiring line, provided separately from the first power supply wiring line, that connects the second power supply terminal and the digital circuit.

10. A printing apparatus comprising:
a printhead; and
a control unit configured to control the printhead,
wherein the printhead comprises:
a printing element;
a driving circuit configured to drive the printing element;
an analog signal processing circuit configured to process an analog signal; and
a bias circuit configured to supply a bias voltage to the analog signal processing circuit,
wherein it is possible to switch starting and stopping of at least one of the analog signal processing circuit and the bias circuit based on a control signal, and
the control unit outputs the control signal to the printhead.

11. The printing apparatus according to claim 10,
wherein the printhead comprises:
a plurality of print element substrates including at least first and second print element substrates; and
a wiring substrate electrically connected to the plurality of print element substrates, and
wherein the plurality of print element substrates each comprises:
the printing element;
the driving circuit;
the analog signal processing circuit; and
the bias circuit, and
wherein the wiring substrate comprises:
a control terminal to which the control signal outputted from the control unit is inputted.

12. The printing apparatus according to claim 10,
wherein the printhead comprises a plurality of print element substrates, and
the control unit, with respect to a print element substrate that is not used for printing out of the plurality of print element substrates, outputs to the printhead a control signal indicating stoppage of supply of the bias voltage.

13. The printing apparatus according to claim 10,
wherein the printhead comprises a plurality of element substrates including at least first, second, and third print element substrates, wherein each of the plurality of element substrates is allocated to at least first and second groups,
wherein the plurality of print element substrates each comprises:
the printing element,
the driving circuit,
the analog signal processing circuit, and
the bias circuit, and
wherein the control unit outputs to the printhead a first control signal corresponding to the first group and a second control signal corresponding to the second group.

14. The printing apparatus according to claim 10,
wherein the printhead comprises:
a plurality of print element substrates including at least first, second, and third print element substrates;
a wiring substrate electrically connected to the plurality of print element substrates,
wherein the plurality of print element substrates are each allocated to at least first and second groups, and
wherein the wiring substrate comprises:
a first control terminal to which a first control signal corresponding to the first group is inputted, and
a second control terminal to which a second control signal corresponding to the second group is inputted.

* * * * *